US009938660B2

(12) United States Patent
Gomi et al.

(10) Patent No.: US 9,938,660 B2
(45) Date of Patent: Apr. 10, 2018

(54) PAPER MANUFACTURING APPARATUS, PAPER MANUFACTURING METHOD, AND PAPER MANUFACTURED THEREBY

(71) Applicant: SEIKO EPSON CORPORATION, Tokyo (JP)

(72) Inventors: Katsuhito Gomi, Nagano (JP); Masahide Nakamura, Nagano (JP); Yoshiaki Murayama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/109,468

(22) PCT Filed: Sep. 26, 2014

(86) PCT No.: PCT/JP2014/004934
§ 371 (c)(1),
(2) Date: Jul. 1, 2016

(87) PCT Pub. No.: WO2015/111104
PCT Pub. Date: Jul. 30, 2015

(65) Prior Publication Data

US 2016/0333521 A1 Nov. 17, 2016

(30) Foreign Application Priority Data

Jan. 23, 2014 (JP) ..... 2014-010155

(51) Int. Cl.

| | |
|---|---|
| ***D21B 1/06*** | (2006.01) |
| ***D21B 1/08*** | (2006.01) |
| ***B27N 1/02*** | (2006.01) |
| ***D21F 11/00*** | (2006.01) |
| ***D21H 17/20*** | (2006.01) |
| ***D21F 9/00*** | (2006.01) |

(52) U.S. Cl.
CPC ..... *D21B 1/08* (2013.01); *B27N 1/02* (2013.01); *D21B 1/06* (2013.01); *D21F 9/00* (2013.01); *D21F 11/00* (2013.01); *D21H 17/20* (2013.01)

(58) Field of Classification Search
None
See application file for complete search history.

(56) References Cited

U.S. PATENT DOCUMENTS

| | | | | |
|---|---|---|---|---|
| 5,057,166 | A | 10/1991 | Young, Sr. et al. | |
| 5,064,689 | A | 11/1991 | Young, Sr. et al. | |
| 6,270,893 | B1 * | 8/2001 | Young, Sr. ..... | A61F 13/531 428/359 |

(Continued)

FOREIGN PATENT DOCUMENTS

| | | | |
|---|---|---|---|
| CN | 102869822 | A | 1/2013 |
| EP | 2664708 | A1 | 11/2013 |

(Continued)

*Primary Examiner* — Mark Halpern
(74) *Attorney, Agent, or Firm* — Global IP Counselors, LLP

(57) ABSTRACT

A paper manufacturing apparatus that can manufacture paper with good mechanical strength and/or water resistance in a dry process.
A paper manufacturing apparatus according to the invention has a defibrating unit that defibrates feedstock in air; a mixing unit that mixes an additive containing resin with defibrated material that was defibrated; and a heat unit that heats a mixture into which the defibrated material and the additive were mixed.

6 Claims, 2 Drawing Sheets

(56) References Cited

U.S. PATENT DOCUMENTS

| | | | | |
|---|---|---|---|---|
| 8,882,965 | B2 | 11/2014 | Yamagami et al. | |
| 9,194,081 | B2 | 11/2015 | Yamagami | |
| 9,315,941 | B2 * | 4/2016 | Gomi | D21F 3/04 |
| 2011/0247839 | A1 | 10/2011 | Lalouch et al. | |
| 2014/0345882 | A1 | 11/2014 | Lalouch et al. | |

FOREIGN PATENT DOCUMENTS

| | | | |
|---|---|---|---|
| JP | 04-504287 | A | 7/1992 |
| JP | 08-120551 | A | 5/1996 |
| JP | 2012-144819 | A | 8/2012 |

* cited by examiner

PAPER MANUFACTURING APPARATUS, PAPER MANUFACTURING METHOD, AND PAPER MANUFACTURED THEREBY

This application is a 371 of PCT/JP2014/004934 filed 26 Sep. 2014.

TECHNICAL FIELD

The present invention relates to a paper manufacturing apparatus, a paper manufacturing method, and paper manufactured by the same.

BACKGROUND

For centuries paper has been manufactured by screening pulp slurry (paper machine). Even today paper is typically manufactured in a pulp slurry method. Paper manufactured by a slurry method generally has a structure in which cellulose fibers derived from wood, for example, are interlocked and bonded in part by the cohesive force of hydrogen bonds.

Slurry methods are wet methods, however, require a large amount of water, require dewatering and drying after the paper is made, thus requiring significant energy and time. The water that is used must also be appropriately processed as waste water. The equipment used in pulp slurry methods also require large-scale utilities and infrastructure for water, power, and water treatment needs, and is therefore difficult to scale down.

From the perspectives of energy conservation and environmental protection, so-called dry methods that use no or substantially no water are desired as methods of making paper without using a wet slurry, and PTL 1, for example, describes a paper recycling system that defibrates and deinks paper used as the feedstock in a dry process, adds a small amount of water to increase paper strength, and forms paper.

CITATION LIST

Patent Literature

[PTL 1] JP-A-2012-144819

SUMMARY OF INVENTION

Technical Problem

Properties required of paper include mechanical strength such as tensile strength and tear strength. Paper manufactured by the paper-making system described in PTL 1 conceivably provides greater strength than when absolutely no water is added. With the technology described in PTL 1, the water that is added during paper molding is believed to work to induce hydrogen bonds derived from the hydroxyl radicals as the cohesive force between the cellulose fibers in the paper. It is thought that when the paper is dry the mechanical strength of the paper can be increased to some degree by the hydrogen bonds.

The strength of such hydrogen bonds decreases in the presence of water, however. As a result, paper that uses hydrogen bonds as the cohesive force between fibers may therefore have insufficient mechanical strength or change shape when the paper is exposed to high humidity conditions or is wetted with water. Furthermore, while adding water can increase mechanical strength to some degree compared with not adding water, mechanical strength can still not be said to be sufficient.

An object of several embodiments of the invention is to provide a paper-making system that can manufacture by a dry method paper having good mechanical strength and/or water resistance, a method of making paper, and paper manufactured thereby having good mechanical strength and/or water resistance.

Solution to Problem

The present invention is directed to solving at least part of the foregoing problem, and canoe achieved by the embodiments or examples described below.

A paper manufacturing apparatus according to an aspect of the invention has: a defibrating unit that defibrates feedstock in air; a mixing unit that mixes an additive containing resin in defibrated material that was defibrated; and a heat unit that heats a mixture into which the defibrated material and the additive were mixed.

The paper manufacturing apparatus thus comprised mixes an additive containing resin with defibrated material in air by a mixing unit. The heat unit then binds the fiber in the defibrated material by melting the resin in the additive. More specifically, a cohesive force can be applied by the resin between the fibers of the defibrated material. Paper with high mechanical strength can therefore be manufactured by a dry method by the paper manufacturing apparatus thus comprised. Furthermore, the paper manufactured by such a paper manufacturing apparatus retains its mechanical strength and is resistant to changes in shape because interfiber bonds are maintained by the resin even when exposed to high humidity, wetted with water, or the strength of the hydrogen bonds between fibers weakens. Therefore, paper with good water resistance can be made by this paper manufacturing apparatus.

The paper manufacturing apparatus of the invention may also have a compression unit that compresses the mixture without heating before or after the heat unit.

The paper manufacturing apparatus thus comprised can make paper with greater surface smoothness. More specifically, if the compression unit is before the heat unit, heat can be applied after applying pressure and reducing the thickness of the mixture. As a result, because the resin melts with the fibers of the mixture close together, the fibers can be reliably bonded and thin paper with high mechanical strength can be made.

The paper manufacturing apparatus according to the invention wherein the feedstock may be used paper; and having a classifier that classifies the defibrated material is between the defibrating unit and the mixing unit.

The paper manufacturing apparatus thus comprised can remove toner and other components from used paper. The whiteness of the manufactured paper can therefore be improved. In addition, because toner and other impurities are removed and factors inhibiting fiber-resin bonds can be removed, paper with high mechanical strength can be made.

The paper manufacturing apparatus according to the invention wherein the additive includes an integrated composite of at least the resin and an anti-blocking agent.

Furthermore, while mixing the resin and anti-blocking agent individually with the defibrated material has some effect of suppressing further blocking of agglomerated resin, blocking of resin alone cannot be suppressed. In this case, resin cannot be uniformly distributed, and high strength places and low strength places result. However, because the additive (composite) containing resin is integrated with the anti-blocking agent in this paper manufacturing apparatus, an anti-blocking effect can be imparted. As a result, the composite can be mixed and more uniformly distributed in the defibrated material. As a result, paper with excellent mechanical strength and water resistance can be made.

In a paper manufacturing apparatus according to the invention, the composite may be integrated with a coloring agent.

Because the composite integrates the coloring agent and resin in this paper manufacturing apparatus, it is difficult for the coloring agent to separate from the composite. Because the composite and defibrated material bond, it becomes more difficult for the coloring agent to separate from the composite. As a result, color paper in which color variation is suppressed can be made.

Paper according to an aspect of the invention contains defibrated material acquired by defibrating used paper, and an additive containing resin, and the defibrated material and the additive are bonded.

Because defibrated material is bonded by an additive containing resin in this paper, mechanical strength is high. Such paper also retains its mechanical strength, is resistant to changes in shape, and has good water resistance because interfiber bonds are maintained by the resin integrated in the composite even when exposed to high humidity, wetted with water, or the interfiber hydrogen bonds weaken.

A paper-making method according to an aspect of the invention includes: a process of defibrating feedstock in air; a process of mixing in air defibrated material that was defibrated and an additive containing resin; and a process of heating a mixture of the defibrated material mixed with the additive.

This paper-making method bonds the defibrated material and additive containing resin by applying heat, and can therefore produce cohesive force by the resin in the defibrated material. Therefore, this paper-making method can make paper with high mechanical strength in a dry method. Furthermore, the paper manufactured by this paper-making method retains its mechanical strength and is resistant to changes in shape because interfiber bonds are maintained by the resin even when the paper is exposed to high humidity or wetted with water and the strength of the interfiber hydrogen bonds weakens. Paper with good water resistance can therefore be manufactured by this paper-making method.

DESCRIPTION OF EMBODIMENTS

Preferred embodiments of the invention are described below. The embodiments described below describe exemplary embodiments of the invention. The invention is not limited to the following examples, and includes variations thereof not departing from the scope of the accompanying claims. Note that embodiments of the invention do not necessarily require all configurations described below.

1. Paper Manufacturing Apparatus

Figure 1:
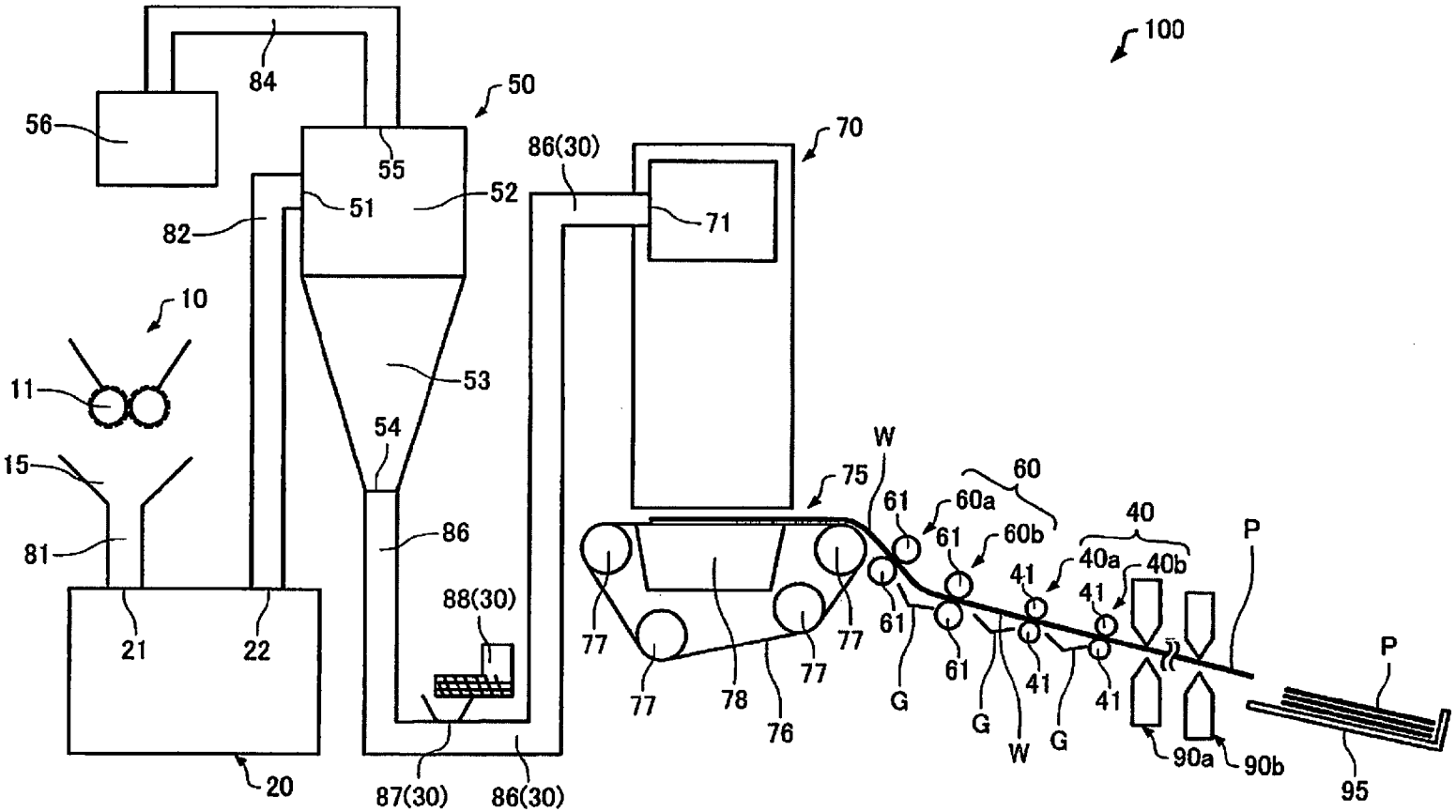
FIG. 1 schematically illustrates a paper manufacturing apparatus according to the invention.

A paper manufacturing apparatus 100 according to the invention has a defibrating unit 20, a mixing unit 30, and a heat unit 40. FIG. 1 schematically illustrates the configuration of a paper manufacturing apparatus 100 according to this embodiment. Below, the paper manufacturing apparatus 100 of this embodiment is described with particular reference to the defibrating unit 20, mixing unit 30, and heat unit 40.

1.1. Defibrating Unit

The defibrating unit 20 defibrates the feedstock to be defibrated. By defibrating the feedstock, the defibrating unit 20 produces defibrated material that is detangled into fibers. The defibrating unit 20 also functions to separate particulate such as resin, ink, toner, and sizing agents adhering to the feedstock from the fibers.

The defibration process is a process of separating feedstock material comprising bonded fibers into individual fibers. Material that has past through the defibrating unit 20 is referred to as defibrated material. In addition to untangled fibers, the defibrated material may also contain resin particles (resin used to hold multiple fibers together) and ink particles such as ink, toner, and sizing agents, that are separated from the fibers when the fibers are detangled. The detangled defibrated material is string- or ribbon-shaped. The detangled defibrated material may be not interlocked with (be separate from) other detangled fibers, or may be interlocked in clumps with other detangled defibrated material (forming fiber clumps).

In the paper manufacturing apparatus described herein, terms such as upstream and downstream are used in reference to the flow (including conceptual flow) of the material in the manufactured paper (including raw materials, feedstock, defibrated material, web). The terms upstream side (and downstream side) are used to identify the relative positions of components such that, for example, "A is on the upstream side (downstream side) of B" means that the location of A relative to the location of B is upstream (downstream) in the direction of the flow of the paper material.

The defibrating unit 20 is upstream from the mixing unit 30 described below. Other components may be disposed between the defibrating unit 20 and the mixing unit 30. Other components may also be further upstream from the defibrating unit 20.

The defibrating unit 20 may be any configuration with the ability to defibrate the feedstock. The defibrating unit 20 defibrates in air (air) in a dry defibration process. In the example shown in the figures, the feedstock introduced from the inlet port 21 is defibrated by the defibrating unit 20, becoming defibrated material (fiber); and the defibrated material discharged from the outlet port 22 is then supplied to the mixing unit 30 through a conduit 82, classifier 50, and another conduit 86.

A dry process as used herein means processing in air (air) and not liquid. "Dry" encompasses a dry state, and the presence of liquids that are present as impurities, and liquids that are intentionally added.

The configuration of the defibrating unit 20 is not specifically limited, and in one example has a rotary unit (rotor) and a stationary unit covering the rotating unit with a space (gap) between the rotary unit and the stationary unit. When the defibrating unit 20 is thus comprised, the defibration process is done by introducing the feedstock to this gap while the rotary unit is turning. In this event, the speed and shape of the rotary unit, and the shape of the stationary unit, can be designed appropriately to the properties of the paper to be made and the requirements of the overall device configuration. The rotational speed (revolutions per minute (rpm)) of the rotary unit can be set appropriately with consideration for the throughput of the defibration process, the retention time of the feedstock, the degree of defibration, the size of the gap, and the shape, size, and other factors of the rotary unit, stationary unit, and other members.

Note that the defibrating unit 20 further preferably has means for producing an air current to suction the feedstock and/or discharge the defibrated material. In this event, the defibrating unit 20 can by its self-generated air flow pull in the feedstock with the air flow from the inlet port 21, defibrate, and then convey the defibrated material to the outlet port 22. The defibrated material discharged from the outlet port 22 is conveyed through the conduit 82 in the example shown in FIG. 1. If a defibrating unit 20 without a blower mechanism is used, a mechanism may alternatively be externally disposed to produce an air flow carrying the feedstock to the inlet port 21, and an air flow that discharges the defibrated material from the outlet port 22.

1.1.1 Feedstock

The feedstock as used herein refers to objects containing the material to be processed by the paper manufacturing apparatus 100, including pulp sheets, paper, used paper, tissue paper, kitchen paper, cleaning paper, filter paper, liquid absorption materials, sound absorption materials, cushioning materials, mats, cardboard, and other products comprising interlocked or bonded fibers. Fibers (organic fiber, inorganic fiber, and blends of organic and inorganic fibers) made of rayon, Lyocell, cupro, Vinylon, acrylic, nylon, aramid, polyester, polyethylene, polypropylene, polyurethane, polyimide, carbon, glass, or metal may also be contained in the feedstock. When the classifier 50 described below is also included in the paper manufacturing apparatus 100 according to the invention, used paper in particular can be effectively used as the feedstock.

1.1.2 Defibrated Material

The defibrated material that is used in the paper manufacturing apparatus 100 according to this embodiment as part of the material in the manufactured paper is not specifically limited, and a wide range of defibrated materials that can be used to make paper can be used. The defibrated material includes the fibers acquired by defibrating the feedstock described above, and examples of such fiber includes natural fiber (animal fiber, plant fiber) and synthetic fiber (organic fiber, inorganic fiber, and blends of organic and inorganic fibers). Yet more specifically, fibers derived from cellulose, silk, wool, cotton, true hemp, kenaf, flax, ramie, jute, manila, sisal, evergreen trees, and deciduous trees may be contained in the defibrated material, the fibers may be used alone, mixed with other fibers, or refined or otherwise processed as regenerated fiber. The defibrated material is the material from which is paper is then made, and may include only one type of fiber. The defibrated material (fiber) may also be dried, or it may contain or be impregnated with water, organic solvent, or other liquid. Various types of surface processing may also be applied to the defibrated material (fiber).

The average diameter (the diameter of the circle assuming a circle with the same area as the area in cross section, or the maximum length in the direction perpendicular to the length when not round in section) of the single independent fibers contained in the defibrated material used in this embodiment of the invention is on average greater than or equal to 1 μm and less than or equal to 1000 μm, preferably greater than or equal to 2 μm and less than or equal to 500 μm, and further preferably greater than or equal to 3 μm and less than or equal to 200 μm.

The length of the fibers contained in the defibrated material used in this embodiment is not specifically limited, but the length of single independent fibers along the length of the fiber is preferably greater than or equal to 1 μm and less than or equal to 5 mm, is further preferably greater than or equal to 2 μm and less than or equal to 3 mm, and is yet further preferably greater than or equal to 3 μm and less than or equal to 2 mm. When the fiber length is short, the strength of the paper may be insufficient because bonding with additives (compounds) is more difficult. The length along the length of the fiber (fiber length) may also be the length between the two ends when the ends of an independent single fiber are pulled without breaking the fiber to form a substantially straight line. Expressed as the length-length-weighted mean length, the average fiber length is preferably greater than or equal to 20 μm and less than or equal to 3600 μm, is further preferably greater than or equal to 200 μm and less than or equal to 2700 μm, and is yet further preferably greater than or equal to 300 μm and less than or equal to 2300 μm. The fiber length may also have some variation (distribution).

"Fiber" as used herein may refer to a single fiber or an agglomeration of multiple fibers (such as cotton); and defibrated material refers to material containing multiple fibers, and includes both the meaning of an agglomeration of fibers and the meaning of a collection of materials (powder or fiber objects) that are used to make paper.

1.2. Mixing Unit

The mixing unit 30 of the paper manufacturing apparatus 100 according to this embodiment functions to mix (blend) the defibrated material and additives including resin in air. At least defibrated material and additives are mixed in the mixing unit 30. Components other than the defibrated material and additives may also be intermixed by the mixing unit 30. In this embodiment, mixing defibrated material and additives means positioning additives between the fibers contained in the defibrated material within a space (system) of a constant volume.

Insofar as the mixing unit 30 mixes the defibrated material (fiber) and additives, the mixing unit 30 is not specifically limited to any specific configuration, structure, or mechanisms, for example. In addition, the mixing process of the mixing unit 30 may be run as a batch operation (batch process), a serial process, or a continuous process. The mixing unit 30 may also be operated manually or automatically. Yet further, the mixing unit 30 mixes at least defibrated material and additives, but may also be configured to mix other components.

The mixing unit 30 is on the downstream side of the defibrating unit 20 described above. The mixing unit 30 is also on the upstream side of the heat unit 40 described below. Other configurations may also be disposed between the mixing unit 30 and the heat unit 40. These other configurations may include but are not limited to a detangler 70 for detangling the mixture of defibrated material and additives, a sheet-forming unit 75 that forms the mixture into a web, and a calendering unit 60 that applies pressure to the mixture laid as a web (each described below). Note that the mixture combined by the mixing unit 30 may be further mixed by the detangler 70 or other part, and the detangler 70 may also be considered a mixing unit.

Examples of the mixing process of the mixing unit 30 include mechanical mixing and mixing by means of fluid dynamics. Examples of mechanical mixing include methods of introducing fiber (defibrated material) and additives to a Henschel mixer for stirring, and methods of enclosing the fiber (defibrated material) and additives in a bag and shaking the bag. A process for mixing by means of fluid dynamics may, for example, load the fiber (defibrated material) and additives into a current of air, for example, and disperse the fiber (defibrated material) and additives in air. In the method that introduces the fiber (defibrated material) and additives to an air current, the additives may be injected to a conduit through which the fibers of the defibrated material are carried (transported) by the air flow, or the fiber (defibrated material) may be injected to a conduit through which the additives are carried (transported) by the air flow. Note that in this event, a turbulent air flow through the conduit mixes more efficiently and is therefore preferable.

The mixing unit 30 may also be configured with a feeder that introduces the additives to the flow channel of the defibrated material. For example, if a conduit 86 is used as the mixing unit 30 to carry the defibrated material as shown in FIG. 1, one method is to introduce the additives from an additive supply unit 88 while the defibrated material is flowing through the air current. A blower not shown is one example of a means of generating an air current when a conduit 86 is used in the mixing unit 30, and the blower may be disposed as needed to achieve this function.

Introduction of the additive (including when the additive is a composite) when a conduit 86 is part of the mixing unit 30 could be done by opening and closing a valve or manually by the operator, but a screw feeder such as shown in FIG. 1 or a disc feeder, for example, may also be used as the additive supply unit 88. When such a feeder is used, variation in the amount (added amount) of the additives is preferably minimized in the direction of the air flow. This also applies when the additive is conveyed by air and the defibrated material is added to the air flow. In the example shown in the figure, the additive is supplied from the additive supply unit 88 to the conduit 86 through a supply inlet 87 disposed to the conduit 86. In the example shown in the figure, the mixing unit 30 is therefore embodied by part of the conduit 86, the additive supply unit 88, and the supply inlet 87.

In the paper manufacturing apparatus 100 according to this embodiment, the mixing unit 30 is a dry process unit. As used here, dry mixing means mixing in air (air), not liquid. In other words, the mixing unit 30 may operate in a dry state, or it may operate in the presence of liquid as an impurity or liquid that is added intentionally. When liquid is added intentionally, the liquid is preferably added to the extent that the energy and time required to remove the liquid by heating, for example, in a later process is not too great.

Insofar as the defibrated material and additives can be mixed, the processing capacity of the mixing unit 30 is not specifically limited and can be desirably designed and adjusted according to the production capacity (throughput) of the paper manufacturing apparatus 100. If operating in a batch process mode, the throughput of the mixing unit 30 may be adjusted by changing the size of the processing vessel or the size of the load; and when a conduit 86 and additive supply unit 88 as described above are used as the mixing unit 30, the throughput may be adjusted by changing the amount of air carrying the defibrated material and additives through the conduit 86, the amount of material that is introduced, or the conveyance capacity, for example. Note that the defibrated material and additives can be sufficiently mixed even when a conduit 86 and additive supply unit 88 as shown in the figures are used as the mixing unit 30.

The additive supplied from the additive supply unit 88 includes resin to bond multiple fibers together. At the time the additive is introduced to the conduit 86, multiple fibers contained in the defibrated material are not intentionally bonded other than when defibration is insufficient. The resin contained in the additive melts or softens when passing the heat unit 40 described below and is then cured to bond multiple fibers.

1.2.1. Additive

The additive supplied from the additive supply unit 88 includes resin. The type of the resin may be a natural resin or a synthetic resin, and may be a thermoplastic resin or a thermoset resin. In the paper manufacturing apparatus 100 according to this embodiment, the resin is preferably a solid at room temperature, and considering bonding the fibers by heat in the heat unit 40, is preferably a thermoplastic resin.

Examples of natural resins include rosin, dammar, mastic, copal, amber, shellac, Dragon's blood, sandarac, and colophonium, which may be used individually or in appropriate mixtures, and may be appropriately denatured.

Examples of synthetic resins that are thermoset resin include thermosetting resins such as phenol resin, epoxy resin, melamine resin, urea resin, unsaturated polyester resin, alkyd resin, polyurethane, and thermoset polyimide resin.

Examples of synthetic resins that are thermoplastic resin include AS resin, ABS resin, polypropylene, polyethylene, polyvinyl chloride, polystyrene, acrylic resin, polyester resin, polyethylene terephthalate, polyethylene ether, polyphenylene ether, polybutylene terephthalate, nylon, polyimide, polycarbonate, polyacetal, polyphenylene sulfide, and polyether ether ketone.

The resins may be used individually or in combination. The resins may also be copolymerized or modified, examples of such resins including styrene-based resin, acrylic-based resin, styrene-acrylic copolymers, olefin-based resin, vinyl chloride-based resin, polyester-based resin, polyamide-based resin, polyurethane-based resin, polyvinyl alcohol-based resin, vinyl ether-based resin, N-vinyl-based resin, and styrene-butadiene-based resin.

The additive may be fibrous or powder. If the additive is fibrous, the fiber length of the additive is preferably less than or equal to the fiber length of the defibrated material. More specifically, the fiber length of the additive is preferably less than or equal to 3 mm, and further preferably less than or equal to 2 mm. If the fiber length of the additive is greater than 3 mm, mixing the additive uniformly with the defibrated material may be difficult. If the additive is a powder, the particle size (diameter) of the additive is greater than or equal to 1 μm and less than or equal to 50 μm, and is more preferably greater than or equal to 2 μm and less than or equal to 20 μm. If the particle size of the additive is less than 1 μm, the cohesive force bonding the fibers of the defibrated material may drop. If the particle size of the additive is greater than 20 μm, mixing the additive uniformly with the defibrated material may be more difficult, adhesion with the defibrated material drops and the additive may separate from the defibrated material, and irregularities may result in the manufactured paper.

The amount of additive that is supplied from the additive supply unit 88 is set appropriately according to the type of paper to be made. In the example shown in the figures, the supplied additive is mixed with the defibrated material inside the conduit 86 of the mixing unit 30.

Note that the additive may contain components other than resin. Examples of such other components include anti-blocking agents, coloring agents, organic solvents, surfactants, fungicides, preservatives, anti-oxidants, ultraviolet absorber, and oxygen absorbers. Anti-blocking agents and coloring agents are described more specifically below.

1.2.1.1. Anti-Blocking Agents

In addition to resin for binding the defibrated material, the additive may also contain an anti-blocking agent to suppress the agglomeration of fibers in the defibrated material and resin in the additive. When the anti-blocking agent is included in the additive, the resin and anti-blocking agent are preferably integrated. More specifically, to include the anti-blocking agent in the additive, the additive is preferably an integrated composite of the resin and the anti-blocking agent.

A "composite" as used herein means a particle formed by integrating the resin as one component with another component. "Another component" refers to an anti-blocking agent or coloring agent, for example, and may differ from the resin as the main component in shape, size, material, and function.

When an anti-blocking agent is mixed in the additive, the composite particles integrating resin with the anti-blocking agent are more resistant to blocking than when the anti-blocking agent is not included. Various types of anti-blocking agents may be used, but because the paper manufacturing apparatus 100 according to this embodiment uses no or little water, the anti-blocking agent is preferably imparted to the surface of the composite particles (and may be a coating (covering)).

One example of an anti-blocking agent is a fine particulate of inorganic material, which by being disposed to the surface of the composite achieves a particularly outstanding anti-blocking effect. Agglomeration refers to objects of the same or dissimilar types being held in physical contact by electrostatic force or van der Waals' forces. In addition, there being no blocking in an agglomeration of multiple particles (such as a powder) does not necessarily mean that all particles in the agglomeration are discretely dispersed. More specifically, no blocking includes blocking of some of particles in the agglomeration, and even if the amount of blocked particles is less than or equal to 10 wt %, and preferably less than or equal to 5 wt %, of the total agglomeration, this state is included in there being no blocking in the agglomeration of multiple particles. Furthermore, when powder is packed in a bag, the particles of the powder will be in contact, but if the particles can be separated by applying an external force that is not sufficient to crush the particles, such as by gentle stirring, dispersion by air, or a free fall, this is also considered as there being no blocking.

Specific examples of materials that may be used as an anti-blocking agent include silica, titanium oxide, aluminum oxide, zinc oxide, cerium oxide, magnesium oxide, zirconium oxide, strontium titanate, barium titanate, and calcium carbonate. Some materials that can be used as an anti-blocking agent (such as titanium oxide) may also be used as coloring agents, but differ in that the particle diameter of the anti-blocking agent is smaller than the particle diameter of the coloring agent. As a result, the anti-blocking agent does not greatly affect the color of the manufactured paper, and can be differentiated from the coloring agent. However, even if the particle size of the anti-blocking agent is small, the anti-blocking agent may have a slight effect on the scattering of light, and this effect is preferably considered when adjusting the color of the paper.

The mean particle size (number average particle size) of the particles in the anti-blocking agent is not specifically limited, but is preferably 0.001-1 μm, and more preferably 0.008-0.6 μm. Because particles of the anti-blocking agent are very small, near the range of nanoparticles, they are generally primary particles. However, plural primary particles in an anti-blocking agent may combine to form high order particles. If the particle size of the primary particles is within the range described above, the surface of the particles can be desirably coated, giving the composite a sufficient anti-blocking effect. Particles of a composite having an anti-blocking agent disposed to the surface of the resin particles have an anti-blocking agent between one composite particle and another composite particle, and clumping thereof is suppressed. Note that if the resin and anti-blocking agent are discrete and not integrated, anti-blocking agent will not necessarily always be between one resin particle and another resin particle, and the anti-blocking effect between resin particles is lower than when the anti-blocking agent and resin are integrated.

The amount of anti-blocking agent in a integrated composite of resin and anti-blocking agent is preferably greater than or equal to 0.1 parts by weight and less than or equal to 5 parts by weight relative to 100 parts by weight of the composite. The effect described above can be achieved with this content. Considering, for example, improving the foregoing effect and/or suppressing the loss of anti-blocking agent from the manufactured paper, the content is further preferably greater than or equal to 0.2 parts by weight and less than or equal to 4 parts by weight, and yet further preferably greater than or equal to 0.5 parts by weight and less than or equal to 3 parts by weight, relative to 100 parts by weight of the composite.

When the anti-blocking agent is imparted to the surface of the resin, a good anti-blocking effect can be obtained if the ratio of the surface of the composite that is coated with anti-blocking agent (area ratio: also referred to herein as the coverage) is greater than or equal to 20% and less than or equal to 100%. The coverage can be adjusted by mixing in a device such as an FM Mixer. Furthermore, if the specific surface areas of the anti-blocking agent and resin are known, the coverage can be adjusted by controlling the mass (weight) of the components in the preparation. The coverage can also be measured by various types of electron microscopes. Note that if the anti-blocking agent is imparted to the composite in such a way that separation from the resin is difficult, the anti-blocking agent and resin may be said to be integrated.

Because blocking of composites can be made extremely difficult by including an anti-blocking agent in the composite, the additives (composite) and defibrated material can be mixed even more easily in the mixing unit 30. More specifically, if an anti-blocking agent is combined with the additive as a composite with the resin, the composite can be quickly distributed in space, and a more uniform distribution of the defibrated material and additive can be created than when an anti-blocking agent is not included.

1.2.1.2. Coloring Agent

In addition to resin for binding the defibrated material, the additive may also contain a coloring agent. When the additive contains a coloring agent, the resin and coloring agent are preferably integrated. More specifically, the additive is preferably a composite of the resin and the coloring agent. If the composite includes the anti-blocking agent described above, the resin, coloring agent, and anti-blocking agent can be integrated in a single composite. More specifically, the additive can include an integrated composite of the resin, anti-blocking agent, and coloring agent.

An integrated composite of resin and coloring agent means that the coloring agent is resistant to separation (resistant to loss) in the paper manufacturing apparatus 100 and/or the manufactured paper. In other words, an integrated composite of resin and coloring agent refers to the coloring agent being bonded with the resin, coloring agent being structurally (mechanically) affixed to resin, an agglomeration of resin and coloring agent through electrostatic force or van der Waals' forces, for example, or the resin and coloring agent being held together by a chemical bond. The composite integrating resin and coloring agent includes the coloring agent being enveloped by resin or the coloring agent adhering to the resin, or the coloring agent and resin existing in both states simultaneously.

Figure 2:
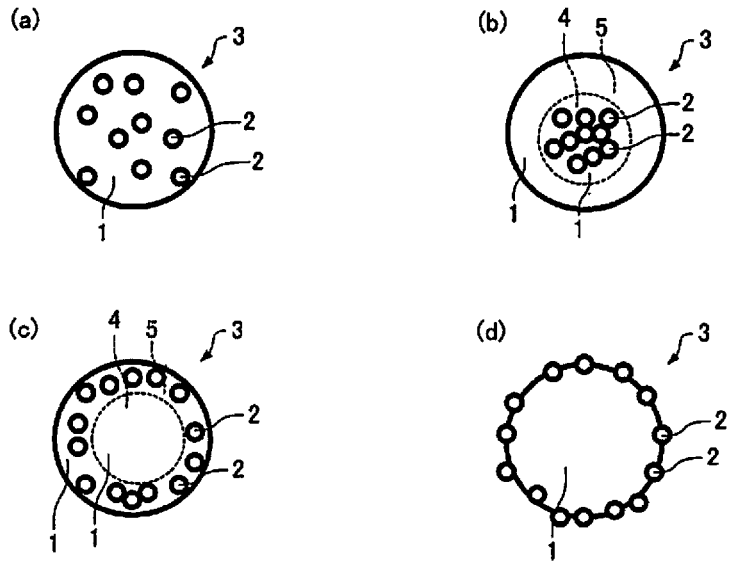
FIG. 2 shows some examples of a composite according to the invention in cross section.

FIG. 2 illustrates several examples of an integrated composite of resin and coloring agent in section. In one example of a specific embodiment of an integrated composite of resin and coloring agent, the composite 3 may have a structure enveloping one or more coloring agents 2 dispersed inside resin 1 as shown in FIG. 2 (*a*) to (*c*), or the composite 3 may have one or more coloring agents on the surface of the resin 1 as shown in FIG. 2 (*d*). The paper manufacturing apparatus 100 according to this embodiment can also use an agglomeration (powder) of such composites 3 as the composite.

FIG. 2 (*a*) shows an example of a composite 3 having a structure in which multiple coloring agents 2 (shown as particles in the figure) are dispersed in the resin 1 body of the composite 3. This composite 3 has a domain-matrix structure in which coloring agent 2 as the domain is dispersed in a resin 1 matrix. Because the coloring agent 2 is surrounded by resin 1 in this example, it is difficult for the coloring agent 2 to pass through the resin portion (matrix) and escape from the resin 1. As a result, separation of the coloring agent 2 from the resin is difficult during processing in the paper manufacturing apparatus 100 and when formed in paper. The coloring agents 2 may be dispersed in the composite 3 in this structure with the coloring agents 2 touching each other, or there may be resin 1 between the coloring agents 2. In the example in FIG. 2 (*a*), the coloring agent 2 is distributed throughout the matrix, but may be biased to one side. For example, the coloring agent 2 may be present only on the right side or the left side in the same figure. In another example of being offset to one side, the coloring agent 2 may be disposed in the center of the resin 1 as shown in FIG. 2 (*b*), or the coloring agent 2 may be disposed near the surface of the resin 1 as shown in FIG. 2 (*c*). Note further that the resin 1 may have a core 4 near the center surrounded by a shell 5. The core 4 and shell 5 may be the same type of resin, or different types of resin.

The example shown in FIG. 2 (*d*) is a composite 3 with coloring agent 2 embedded near the surface of a resin 1 particle. In this example, the coloring agent 2 is exposed at the surface of the composite 3, but separation from the composite 3 is made difficult by adhesion (chemical or physical bonding) with the resin 1 or by mechanical bonding by resin 1, and such composites 3 can be desirably used as an integrated composite 3 of resin 1 and coloring agent 2 in the paper manufacturing apparatus 100 according to this embodiment. In this example, the coloring agent 2 may be inside as well as at the surface of the resin 1.

A number of examples of an integrated composite of resin and coloring agent are described above, but the composite is not so limited insofar as separation of the coloring agent from the resin is difficult during processing in the paper manufacturing apparatus 100 and when the paper is formed, and the coloring agent may be affixed to the surface of resin particles by electrostatic force or van der Waals' forces, for example, as long as separation of the coloring agent from the resin is difficult. Furthermore, various combinations of the plural forms described above by example can be used insofar as separation of the coloring agent from the composite is difficult.

Note that the preferred disposition of the anti-blocking agent composite described in 1.2.1.1. Anti-blocking agent above is conceptually the same as shown in FIG. 2 (*d*). However, it is important to note that the anti-blocking agent has a smaller particle size than the coloring agent 2. In addition, a composite having the anti-blocking agent on the surface can be formed using any of the configurations shown in FIG. 2 (*a*) to (*d*).

The coloring agent functions to impart a specific color to the paper manufactured by the paper manufacturing apparatus 100 in this embodiment of the invention. The coloring agent may be a dye or pigment, and when integrated with resin in a composite, a pigment is preferably used because better opacity and chromogenicity can be achieved.

The color and type of pigment is not specifically limited, and pigments of the colors (such as white, blue, red, yellow, cyan, magenta, yellow, black, and special colors (pearl, metallic luster)) used in common ink can be used. The pigment may be an inorganic pigment or an organic pigment. Pigments known from the literature, such as described in JP-A-2012-97309 and JP-A-2004-250559 can be used as pigment. White pigments such as zinc oxide, titanium oxide, antimony trioxide, zinc sulfide, clay, silica, white carbon, talc, and alumina white may also be used. The pigments may be used individually or desirably mixed. Note that when a white pigment is chosen from among the above examples, using a pigment comprising a powder containing particles (pigment particles) of which titanium oxide is the main component is preferable because the high refractive index of titanium oxide enables easily increasing the whiteness of the manufactured paper with a small amount of pigment.

The defibrated material and additive are mixed in the mixing unit 30, and the mixture ratio of these components can be adjusted according to the desired strength, properties, and application of the manufactured paper. If the manufactured paper is copy paper for office use, for example, the ratio of additive to defibrated material is preferably greater than or equal to 5 wt % and less than or equal to 70 wt %, and is further preferably greater than or equal to 5 wt % and less than or equal to 50 wt % considering better mixing in the mixing unit 30 and greater resistance to the loss of additive due to gravity when the mixture is laid in a web.

1.3. Heat Unit

The paper manufacturing apparatus 100 according to this embodiment has a heat unit 40. The heat unit 40 is located downstream from the mixing unit 30 described above.

The heat unit 40 heats the mixture combined in the mixing unit 30 described above to bind multiple fibers together through the additive. The mixture may be formed into a web, for example. The heat unit 40 may also be able to form the mixture into a specific shape.

Herein, "bind defibrated material and additive" refers to states in which separation of the fibers in the defibrated material and the additive is difficult, and states in which the resin in the additive is disposed between fibers such that separation of the fibers is made difficult by the additive. "Bind" also includes the concept of adhesion, and includes states in which two or more objects are touching and difficult to separate. In addition, when fibers are bonded through a composite, the fibers may be mutually parallel or intersecting, and multiple fibers may be bonded to a single fiber.

The heat unit 40 binds multiple fibers in the mixture together through the additive by applying heat to the mixture of defibrated material and additive mixed in the mixing unit 30. When one of the resins that is part of the additive is a thermoplastic resin, the resin softens or melts when heated to the glass transition temperature (softening point) or a temperature near or exceeding the melting point (in the case of a crystalline polymer), and hardens when the temperature drops. The resin can be softened to interlock with the fibers, and the fiber and additive can then be bonded together by the resin hardening. Fibers can also be bonded by other fibers bonding when the resin hardens. If the resin in the additive is a thermoset resin, fiber and resin can be bonded by heating the resin to a temperature greater than or equal to the softening point, or heating to or above the curing temperature (the temperature at which the curing reaction occurs). Note that the melting point, softening point, and curing temperature of the resin, for example, are preferably lower than the melting point, decomposition temperature, and carbonization temperature of the fiber, and both types of materials are preferably combined to achieve this relationship.

Pressure may be applied in addition to heat to the mixture in the heat unit 40, in which case the heat unit 90 can form the mixture into a specific shape. The amount of pressure applied is appropriately adjusted according to the type of paper to be made, and can be greater than or equal to 50 kPa and less than or equal to 30 MPa. Paper with a high porosity can be made if the applied pressure is low, and paper with low porosity (high density) can be made if the applied pressure is high.

The specific configuration of the heat unit 40 may include, for example, a heat roller (heater roller), hot press molding machine, hot plate, heat blower, infrared heater, or flash heating. In the paper manufacturing apparatus 100 according to the embodiment shown in FIG. 1, the heat unit 40 is configured with a heat roller 41. In the example in the figure, the heat unit 40 heats a web W that has been calendered by the calendering unit 60 (described below). The heat unit 40 may also function to calender the web W. By heating the web W, fibers contained in the web W can be bonded through the additive.

In the example shown in the figure, the heat unit 40 is configured to heat and compress the web W held between rollers, and has a pair of heat rollers 41. The axes of rotation of the pair of heat rollers 41 are parallel to each other. Alternatively to being configured with rollers, the heat unit 40 can be configured with a flat press. In this event, a buffer unit (not shown in the figure) must be provided as needed to temporarily stop the conveyed web while the web is being pressed. Compared with using a flat press as the heat unit 40, however, paper P can be formed while continuously conveying the web W by configuring the heat unit 40 with a heat roller 41.

Figure 3:
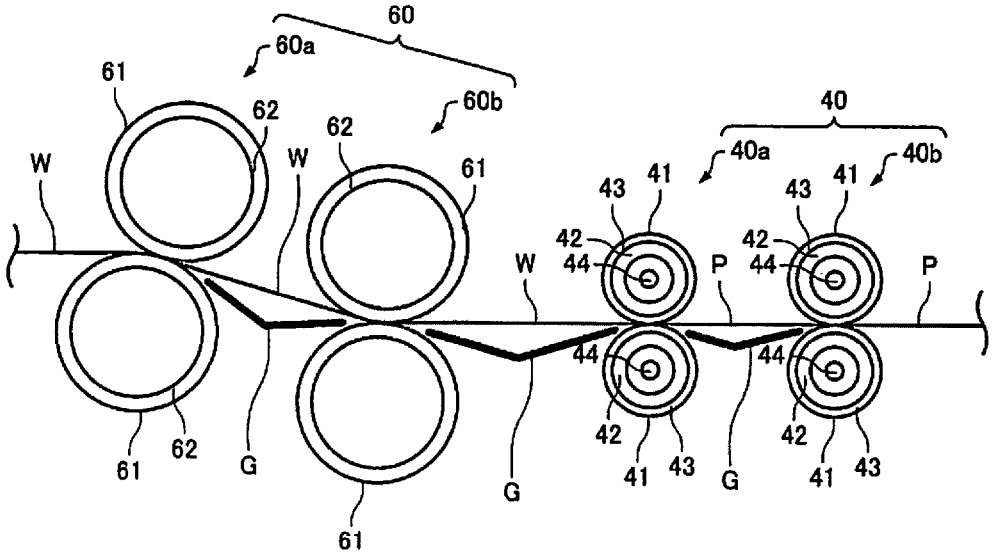
FIG. 3 illustrates main parts of a paper manufacturing apparatus according to the invention.

FIG. 3 schematically illustrates the configuration of the paper manufacturing apparatus 100 near the heat unit 40. The heat unit 40 of the paper manufacturing apparatus 100 according to this embodiment has a first heat unit 90*a* located on the upstream side in the conveyance direction of the web W, and a second heat unit 40*b* located downstream therefrom, and the first heat unit 40*a* and second heat unit 40*b* each have a pair of heat rollers 41. A guide G that assists conveying the web W is also located between the first heat unit 40*a* and second heat unit 40*b*.

The heat roller 41 is a hollow cored bar 42 of aluminum, iron, or stainless steel, for example. On the surface of the heat roller 41 is a tube made of ETA (tetrafluoroethylene-perfluoroalkylvinylether copolymer) or PTFE (polytetrafluoroethylene), or a release layer 43 made of PTFE or other fluororesin coating. Note that a silicon rubber, urethane rubber, cotton, or other type of elastic layer may be disposed between the cored bar 42 and the release layer 43. By imparting an elastic layer, the heat roller 41 pair can contact the web uniformly along the axis of the heat rollers 41 when the pair of heat rollers 41 applies a heavy load.

A halogen heater or other type of heating member 44 is disposed as the heating means inside the cored bar 42. The heat roller 41 and heating member 44 acquire the temperature by a temperature detection means not shown, and driving the heating member 44 is controlled based on the acquired temperature. As a result, the surface temperature of the heat roller 41 can be maintained at a specific temperature. By passing the web W between the heat rollers 41, the conveyed web W can be heated and compressed. Note that the heating means is not limited to a halogen heater, and a heating means that uses a non-contact heater, or a heating means that uses hot air, may be used.

The heat unit 40 shown in the figure has two sets of heat roller 41 pairs as an example, but when a heat roller 41 is used in the heat unit 40, the number and locations of the heat rollers 41 are not specifically limited and may be desirably configured within the scope of providing the foregoing operation. The configuration (release layer, elastic layer, thickness and material of the cored bar, outside diameter of the roller) of the heat roller 41 in each heat unit 40, and the load applied by the heat rollers 41, may also differ in each heat unit 90.

As described above, by passing through the heat unit 40 (heat process), the resin contained in the additive melts and interlocks more easily with the fibers in the defibrated material, and the fibers are bonded. The mixture of defibrated material and additive is formed into paper P by passing through the heat unit 40.

1.4. Operating Effect

The paper manufacturing apparatus 100 according to this embodiment can defibrate feedstock by the defibrating unit 20 to acquire defibrated material, and mix the defibrated material with an additive containing resin by a mixing unit 30 in air. The paper manufacturing apparatus 100 can also bind the fibers in the defibrated material together by the heat unit 40 melting the resin in the additive. More specifically, cohesive force can be produced between the fibers of the defibrated material by the resin. The paper manufacturing apparatus 100 can therefore manufacture paper with high mechanical strength in a dry process. The paper thus manufactured by the paper manufacturing apparatus 100 retains its mechanical strength and resistance to changes in shape even if exposed to a high humidity environment or wetted with water and the strength of the hydrogen bonds in the defibrated material drops because the interfiber bonds in the defibrated material are retained by the resin. The paper manufacturing apparatus 100 thus comprised can therefore manufacture paper with good water resistance.

1.5. Other Configurations

In addition to the defibrating unit, mixing unit, and heat unit described above, the paper manufacturing apparatus 100 according to this embodiment may also have other configurations such as a shredder, classifier, compression unit, separator, detangler, sheet forming unit, and cutting unit. Multiple defibrating units, mixing units, heat units, shredders, classifiers, compression units, separators, detanglers, sheet forming units, and cutting units may also be provided as needed.

1.5.1. Compression Unit

The paper manufacturing apparatus 100 in this embodiment may also have a calendering unit 60. In the paper manufacturing apparatus 100 shown in FIG. 1, the calendering unit 60 is downstream from the mixing unit 30 and upstream from the heat unit 40. The calendering unit 60 compresses without heating the web W formed in a sheet through the detangler 70 and sheet-forming unit 75 described below. Therefore, the calendering unit 60 does not have a heater or other heating means. More specifically, the calendering unit 60 is configured to apply a calendering process.

By applying pressure to (compressing) the web W in the calendering unit 60, the gaps (distance) between fibers in the web W are reduced and web W density increased. As shown in FIG. 1 and FIG. 3, the calendering unit 60 is configured to hold and compress the web W between rollers, and has a pair of calender rolls 61. The axes of rotation of the pair of calender rolls 61 are parallel to each other. The calendering unit 60 of the paper manufacturing apparatus 100 according to this embodiment has a first calender 60*a* located on the upstream side in the conveyance direction of the web W, and a second calender 60*b* located downstream therefrom, and the first calender 60*a* and second calender 60*b* both have a pair of calender rolls 61. A guide G that assists conveying the web W is also located between the first calender 60*a* and second calender 60*b*.

The calender roll 61 is a cored bar 62 of aluminum, iron, or stainless steel, for example, that is hollow or solid (solid). Note that the surface of the calender rolls 61 may be treated for corrosion resistance with an electroless nickel plating or triiron tetraoxide, for example, or may be covered with a tube made of PFA (tetrafluoroethylene-perfluoroalkylvinylether copolymer) or PTFE (polytetrafluoroethylene), or a release layer made of PTFE or other fluororesin coating. Note that a silicon rubber, urethane rubber, cotton, or other type of elastic layer may be disposed between the cored bar 62 and the surface layer. By thus imparting an elastic layer, when the pairs of calender rolls 61 compress with a heavy load, the calender rolls 61 can contact the web uniformly along their axes.

Because the calendering unit 60 applies pressure without applying heat, the resin in the additive does not melt. The web W is compressed and the gaps (distance) between fibers in the web W are reduced in the calendering unit 60. In other words, a high density web W is formed.

The paper manufacturing apparatus 100 in this example has a calendering unit 60 (first calender 60*a* and second calender 60*b*), and a heat unit 40 (first heat unit 40*a* and second heat unit 40*b*). Note that the heat unit 40 also compresses the web W in this example, but the pressure applied by the calendering unit 60 is preferably set greater than the pressure applied by the heat unit 40. For example, the pressure applied by the calendering unit 60 is preferably 500-3000 kgf, and the pressure applied by the heat unit 40 is 30-200 kgf. By setting the pressure of the calendering unit 60 greater than the heat unit 40, the distance between fibers in the web W can be sufficiently shortened by the calendering unit 60, and by then applying heat and pressure, thin, high density, high strength paper can be made.

As shown in FIG. 1 and FIG. 3, the diameter of the calender rolls 61 is greater than the diameter of the heat rollers 41 in a paper manufacturing apparatus 100 according to this embodiment. In other words, the diameter of the calender rolls 61 disposed on the upstream side in the conveyance direction of the web W is greater than the diameter of the heat rollers 41 on the downstream side. Because the diameter of the calender rolls 61 is greater, the uncompressed web W can be gripped and efficiently conveyed. Because the web W that past the calender rolls 61 is compressed and easy to convey, the diameter of the heat rollers 41 downstream from the calender rolls 61 may be smaller. As a result, the device configuration can be made smaller. Note that the diameters of the heat rollers 41 and calender rolls 61 are set appropriately to the thickness of the manufactured web W.

Note that the calendering unit 60 shown in the figure has two sets of calender roll 61 pairs, but when a calendering unit 60 is used and calender rolls 61 are used in the calendering unit 60, the number and location of the calender rolls 61 is not specifically limited and may be freely configured in anyway achieving the operation described above.

The only member that can touch the web W between the calender rolls 61 of the calendering unit 60 and the heat rollers 41 of the heat unit 40 is a guide G as a web support member that can support the web W from below. The distance between the calender rolls 61 and the heat rollers 41 can therefore be shortened. Furthermore, because the calendered web W is quickly heated and compressed, spring back of the web W is suppressed and high strength paper can be formed. Note further that the web W may be compressed after heating. However, because the resin has already started to cure when compressed, even if the the gaps between fibers is shortened by the applied pressure, the fibers are not bonded by the resin, and thin paper cannot be made. As a result, if pressure is applied after heating, the distance between the heat rollers 41 and calender rolls 61 is preferably short enough that pressure can be applied while the resin is still molten.

1.5.2. Classifier

The paper manufacturing apparatus 100 shown in FIG. 1 has a classifier 50 located upstream from the mixing unit 30 and downstream from the defibrating unit 20. The classifier 50 separates and removes resin particles and ink particles from the defibrated material. As a result, the percentage of fiber in the defibrated material can be increased. The classifier 50 is preferably an air classifier. An air classifier is a device that produces a helical air flow, and separates by size and density material that is classified by centrifugal force, and the cut point can be adjusted by adjusting the speed of the air flow and the centrifugal force. More specifically, a cyclone, elbow-jet or eddy classifier, for example, may be used as the classifier 50. A cyclone is particularly well suited as the classifier 50 because of its simple construction. A cyclone classifier 50 is described below.

The classifier 50 has an inlet 51, a cylinder 52 connected to the inlet 51, an inverted conical section 53 located below the cylinder 52 and connected continuously to the cylinder 52, a bottom discharge port 54 disposed in the bottom center of the conical section 53, and a top discharge port 55 disposed in the top center of the cylinder 52.

In the classifier 50, the air flow carrying the defibrated material introduced from the inlet 51 changes to a circular air flow in the cylinder 52, which has an outside diameter of 100 mm or more and 300 mm or less. As a result, the defibrated material that is introduced can be separated by centrifugal force into the fibers of the defibrated material and fine particles such as resin particles and ink particles in the defibrated material. The portion with high fiber content is discharged from the bottom discharge port 54, and is introduced through the conduit 86 to the mixing unit 30. The fine particles are discharged to the outside of the classifier 50 from the top discharge port 55 through a conduit 84. In the example shown in the figure, the conduit 84 is connected to a receiver 56, and the fine particles are collected in the receiver 56. Because fine particles including resin particles and ink particles are discharged to the outside by the classifier 50, the amount of resin relative to the defibrated material can be prevented from becoming excessive even when resin is later added by the additive supply unit 88.

Note that while the classifier 50 is described as separating fiber and particulate, they are not completely separated. For example, relatively small and relatively low density fiber may be externally discharged with the fine particles. Relatively high density particles and particles interlocked with fiber may also be discharged downstream with the fiber.

When the feedstock is pulp sheet instead of used paper, the classifier 50 may be omitted from the paper manufacturing apparatus 100 because fine particles such as resin particles and ink particles are not present. Conversely, the paper manufacturing apparatus 100 is preferably configured with a classifier 50 when the feedstock is used paper in order to improve the color of the paper that is made.

1.5.3. Shredder

The paper manufacturing apparatus 100 may also include a shredder 10. The paper manufacturing apparatus 100 shown in FIG. 1 has a shredder 10 on the upstream side of the defibrating unit 20. The shredder 10 shreds feedstock such as pulp sheet and other sheet material (such as A4 size used paper) supplied thereto in air, producing shredded feedstock. While the shape and size of the shreds are not specifically limited, the shreds are preferably a few centimeters square. In the example in the figure, the shredder 10 has shredder blades 11, and shreds the supplied feedstock by the shredder blades 11. An automatic feeder (not shown in the figure) for continuously feeding feedstock may also be disposed to the shredder 10.

A specific example of the shredder 10 is a paper shredder. In the example in the figure, the feedstock shredded by the shredder 10 is received by a hopper 15 and conveyed to the defibrating unit 20 through a conduit 81. The conduit 81 communicates with the inlet port 21 of the defibrating unit 20.

1.5.4. Detangler

The paper manufacturing apparatus 100 may also have a detangler 70. In the paper manufacturing apparatus 100 shown in FIG. 1, a detangler 70 and sheet-forming unit 75 are disposed downstream from the mixing unit 30. The detangler 70 introduces the mixture that past through the conduit 86 (mixing unit 30) from the inlet 71, and causes the mixture to disperse in air and precipitate. In this example, the paper manufacturing apparatus 100 has a sheet-forming unit 75, and in the sheet-forming unit 75 forms the precipitated mixture from the detangler 70 into an air-laid web W.

The detangler 70 detangles the interlocked defibrated material (fiber). In addition, the detangler 70 detangles interlocked resin when the resin in the additive supplied from the additive supply unit 88 is fibrous. The detangler 70 also works to lay the mixture uniformly on the sheet-forming unit 75 described below. More specifically, "detangle" as used here includes comminuting interlocked material and laying a uniform web. Note that if there is no interlocked material, the detangler 70 has the effect of laying a uniform web.

A sieve (sifter) is used as the detangler 70. One example of a detangler 70 is a rotary sieve that can be turned by a motor. The sieve of the detangler 70 does not need to function to select specific material More specifically, the "sieve" used as the detangler 70 means a device having mesh (filter, screen), and the detangler 70 may cause all defibrated material and additive introduced to the detangler 70 to precipitate.

1.5.5. Sheet Forming Unit

The paper manufacturing apparatus 100 may also have a sheet-forming unit 75. The defibrated material and additive that past through the detangler 70 is laid by the sheet-forming unit 75. As shown in FIG. 1, the sheet-forming unit 75 has a mesh belt 76, tension rollers 77, and suction mechanism 78. The sheet-forming unit 75 may also be configured with a tension roller and take-up roller not shown.

The sheet-forming unit 75 is a device that forms an air-laid web W of the mixture precipitating from the detangler 70 (equivalent to a web forming process in conjunction with the detangler 70). The sheet-forming unit 75 functions to lay the mixture uniformly distributed in air by the detangler 70 on the mesh belt 76.

An endless mesh belt 76 with mesh formed therein and tensioned by the tension rollers 77 (four tension rollers 77 in this embodiment) is disposed below the detangler 70. The mesh belt 76 moves in one direction by rotation of at least one of the tension rollers 77.

Directly below the detangler 70 is a suction mechanism 78 as a suction unit that produces a downward air flow through the mesh belt 76. The mixture dispersed in air by the detangler 70 can be pulled onto the mesh belt 76 by the suction mechanism 78. As a result, the mixture suspended in air can be vacuumed, and the discharge speed from the detangler 70 can be increased. As a result, the productivity of the paper manufacturing apparatus 100 can be increased. The suction mechanism 78 can create a downward air flow in the descent path of the mixture, and can prevent the defibrated material and additive from becoming interlocked during descent.

A continuous web W with the mixture in a uniform layer can then be formed by causing the mixture to precipitate from the detangler 70 while moving the mesh belt 76. "Laid uniformly" means the deposited material is laid in substantially the same thickness and substantially the same density. However, because not all of the precipitate necessarily becomes paper, it is sufficient for the portion that becomes paper to be uniform. "Laid unevenly" means not laid uniformly.

Note that the mesh belt 76 may be made of metal, plastic, cloth, or nonwoven cloth, and may be configured in any way enabling laying fibers and air to pass through. The mesh (diameter) of the mesh belt 76 is, for example, greater than or equal to 60 μm and less than or equal to 250 μm. If the mesh is less than 60 μm, it is difficult for the suction device 78 to maintain a stable air flow. If the mesh is greater than 250 μm, fibers in the mixture may enter the mesh and the size of irregularities in the surface of the formed paper may increase. The suction device 78 can be constructed by forming an air-tight box with a window of a desirable size below the mesh belt 76, and pulling air in through the window so that the pressure inside the box is lower than the ambient pressure.

As described above, a fluffy web W containing much air is formed by passing through the detangler 70 and sheet-forming unit 75 (web forming process). Next, as shown in FIG. 1, the web W laid on the mesh belt 76 is conveyed by the rotating movement of the mesh belt 76. The web W formed on the mesh belt 76 is then conveyed to the calendering unit 60 and the heat unit 40 in the example shown in the figure.

1.5.6. Separator

While not shown in the figures, the paper manufacturing apparatus 100 according to this embodiment may also have a separator. The separator can select fibers of a particular length from the defibrated material processed by the defibrating unit 20. Therefore, the separator is disposed downstream from the defibrating unit 20 and upstream from the detangler 70.

A sieve (sifter) can be used as the separator. The separator has mesh (filter, screen), and separates material of a size that can pass through the mesh from material of a size that cannot pass through. The separator can be configured similarly to the detangler 70 described above, but functions to remove some of the material instead of passing all introduced material like the detangler 70. One example of a separator is a rotary sieve that can be turned by a motor. The mesh of the separator may be a metal screen, expanded metal made by expanding a metal sheet with slits formed therein, or punched metal having holes formed by a press in a metal sheet.

By using a separator, fiber or particles contained in the defibrated material or mixture that are smaller than the size of the mesh can be separated from fiber, undefibrated paper particles, and clumps that are larger than the size of the mesh. The separated materials can also be used selectively according to the paper being made. Material that is removed by the separator may be returned to the defibrating unit 20.

The paper manufacturing apparatus 100 according to this embodiment can also have configurations other than the configurations described above, and plural configurations, including the configurations described above, can be combined desirably according to the purpose. The number and order of the configurations is not specifically limited, and can be designed appropriately according to the objective.

1.5.7 Other

The paper manufacturing apparatus 100 according to this embodiment has a first cutter unit 90*a* and a second cutter unit 90*b* as a cutter unit 90 that cuts the web W in the conveyance direction of the web W (the web W that has past the heat unit 40 is paper P) and transversely downstream from the heat unit 40. The cutter unit 90 can be disposed as required. The first cutter unit 90*a* has a cutter, and cuts the continuous paper P into sheets according to a cutting position set to a specific length. The second cutter unit 90*b* that cuts the paper P along the conveyance direction of the paper P is disposed downstream from the first cutter unit 90*a* in the conveyance direction of the paper P. The second cutting unit 90*b* has a cutter, and cuts (severs) at a specific cutting position in the conveyance direction of the paper P. As a result, paper of a desired size is formed. The cut paper P is then stacked in a stacker 95, for example.

2. Paper-Making Method

The paper-making method of this embodiment of the invention uses the paper manufacturing apparatus 100 described above, and includes a process of mixing defibrated material with an integrated composite of resin and an anti-blocking agent, and a process of bonding the defibrated material and composite. Because the defibrated material, fiber, resin, anti-blocking agent, composite, and bonding are the same as described in the paper manufacturing apparatus described above, detailed description thereof is omitted.

The paper-making method in this embodiment of the invention includes in appropriate order at least one process selected from a group of processes including: a process of cutting pulp sheet, used paper, or other feedstock in air; a defibrating process of breaking the feedstock into fibers in air; an air classifying process of separating material impurities (toner, paper strengthening agents) and fibers that were shortened by defibration (short fibers) from the defibrated material that was defibrated; an air separation process of separating long fibers (long fiber) and undefibrated paper particles that were insufficiently defibrated from the defibrated material; a distribution process of suspending and causing mixed material to precipitate in air; a sheet forming process of laying the precipitated mixed material in air in the shape of a web; a heating process of heating the web; a compression process of applying pressure to the web; and a cutting process of cutting the formed paper. Because the details of these processes are the same as described in the paper manufacturing apparatus described above, detailed description thereof is omitted.

Because an additive containing resin and defibrated material are mixed in air, and fibers in the defibrated material can be bonded by the resin in the additive by heating, this paper-making method can produce cohesive force by the resin between fibers in the defibrated material. Paper with high mechanical strength can therefore be manufactured in a dry process using this paper-making method. Furthermore, because the interfiber bonds in the defibrated material are maintained by the resin, the paper manufactured by this paper-making method retains its mechanical strength and is resistant to changes in shape even if exposed to a high humidity environment or wetted with water and the strength of the hydrogen bonds in the defibrated material drops. Paper with good water resistance can therefore be manufactured by this paper-making method.

3. Paper

An example of paper manufactured by the paper manufacturing apparatus 100 or paper-making method according to this embodiment contains defibrated material acquired by defibrating used paper in air, and an integrated composite of resin and anti-blocking agent (additive), and the defibrated material and composite are bonded.

Note that paper as used herein means a structure of plural fibers bonded by resin two-dimensionally or three-dimensionally. Paper herein is made from fibers contained in pulp or used paper, for example, formed into a sheet. Examples of paper herein include recording paper for handwriting and printing, wall paper, packaging paper, coloring paper, and bristol paper, for example. Paper herein is thinner, denser, and stronger than so-called nonwoven cloth.

Such paper has high strength because the defibrated material is bonded by a composite containing resin. Because the interfiber bonds in the defibrated material are maintained by the resin integrated with the composite, such paper retains its mechanical strength, is resistant to changes in shape, and has good water resistance even if exposed to a high humidity environment or wetted with water and the strength of the hydrogen bonds in the defibrated material drops.

4. Additional Notes

"Uniform" as used herein means, in the case of a uniform dispersion or mixture, that the relative positions of one component to another component in an object that can be defined by components of two or more types or two or more phases are the same throughout the whole system, or identical or effectively equal in each part of a system. Uniformity of coloring or tone means there is no gradation in color and color density is the same when looking at the paper in plan view. However, while uniformity of dispersion and coloring are improved herein by integrating the anti-blocking agent and resin, they are not necessarily the same. Resin that is not integrated in the process that integrates the anti-blocking agent and resin will also result. In addition, resin particles may also be slightly separated without clumping. As a result, even if said to be the same, the distance between all resin particles is not the same, and the density is not completely the same density. When manufactured as paper, it is considered uniform herein if tensile strength is sufficient and color uniformity is visually within an acceptable range. Also herein, uniformity of color, uniformity of tone, and color variation are used with similar meaning.

Words meaning uniform, same, equidistant and similar terms meaning that density, distance, dimensions, and similar terms are equal are used herein. These are preferably equal, but include values deviating without being equal by the accumulation of error, deviation, and such because complete equality is difficult.

Note that if there is water in the system (wet) when mixing defibrated material and additive as conventionally, obtaining a mixture with good uniformity and acquiring good paper was relatively easy because agglomeration of the additive is suppressed by the action of water. However, technology for manufacturing recycled paper in a completely dry system from used paper to recycled paper has at present not been sufficiently proven. In the consideration of the inventors, we have come to understand that one reason is the difficulty of making the process that mixes fiber with strengthening agent (such as resin particles) a dry process. More specifically, if fiber and resin particles are simply blended in a dry system with no adaptation, the fiber and resin particles do not mix sufficiently, and when then formed (laid) into a sheet to get paper, the distribution of resin in the paper is not uniform, and paper with insufficient mechanism strength results. We have also learned that when fiber and resin particles are mixed in a dry system, the resin particles agglomerate easily due to cohesive forces such as van der Waals' forces, and an uneven distribution easily occurs.

The present invention is not limited to the embodiment described above, and can be varied in many ways. For example, the invention includes configurations (configurations of the same function, method, and effect, or configurations of the same objective and effect) that are effectively the same as configurations described in the foregoing embodiment. The invention also includes configurations that replace parts that are not essential to the configurations described in the foregoing embodiment. Furthermore, the invention includes configurations having the same operating effect, and configurations that can achieve the same objective, as configurations described in the foregoing embodiment. Furthermore, the invention includes configurations that add technology known from the literature to configurations described in the foregoing embodiment. For example, the web W in the foregoing embodiment has a single layer, but may have multiple layers, and may be laminated with separately manufactured nonwoven cloth or paper.

REFERENCE SIGNS LIST

1 resin
2 coloring agent
3 composite
4 core
5 shell
10 shredder
11 shredder blades
15 hopper
20 defibrating unit
21 inlet port
22 discharge port
30 mixing unit
40 heat unit
40*a* first heat unit
40*b* second heat unit
41 heat roller
42 cored bar
43 release layer
44 heating member
50 classifier
51 inlet port
52 cylinder
53 conical section
54 bottom discharge port
55 top discharge port
60 calendering unit
60*a* first calender
60*b* second calender
61 calendar roll
62 cored bar
70 detangler
71 inlet port
75 sheet forming unit
76 mesh belt
77 tension roller
78 suction mechanism
81, 82, 84, 86 conduit
87 supply port
88 additive supply unit
90 cutter unit
90*a* first cutter unit
90*b* second cutter unit
95 stacker
100 paper manufacturing apparatus
G guide
W web
P paper.

The invention claimed is:

1. A dry paper manufacturing apparatus comprising:
a defibrating unit that defibrates feedstock in air;
a mixing unit that mixes, in air, defibrated material that has been defibrated, and an additive that has a fibrous shape or a powder shape and contains a composite which has at least resin and an anti-blocking agent that are integrated, the anti-blocking agent suppressing blocking of the composite;
a heat unit that heats a mixture into which the defibrated material and the additive were mixed.

2. The paper manufacturing apparatus described in claim 1, further comprising:
a compression unit that compresses the mixture without heating before or after the heat unit.

3. The paper manufacturing apparatus described in claim 1, further comprising:
a classifier that classifies the defibrated material and is between the defibrating unit and the mixing unit, wherein
the feedstock is used paper.

4. The paper manufacturing apparatus described in claim 1, wherein:
the mixing unit mixes the defibrated material and the composite that is further integrated with a coloring agent.

5. The paper manufacturing apparatus described in claim 1, wherein:
the mixing unit mixes the defibrated material and the composite that contains greater than or equal to 0.1 parts by weight and less than or equal to 5 parts by weight anti-blocking agent to 100 parts by weight of the composite.

6. The paper manufacturing apparatus described in claim 1, wherein:

the mixing unit mixes the defibrated material and the composite that has the anti-blocking agent covering 20% or more and 100% or less of the composite surface.

* * * * *